US005865072A

United States Patent [19]

Jerdee

[11] Patent Number: 5,865,072

[45] Date of Patent: Feb. 2, 1999

[54] CLAMP EXPANDER

[76] Inventor: William J. Jerdee, 4507 N. Monroe, Kansas City, Mo. 64117

[21] Appl. No.: 879,646

[22] Filed: Jun. 20, 1997

[51] Int. Cl.[6] ..... B25B 27/10

[52] U.S. Cl. ..... 81/9.3; 81/424.5; 81/426.5

[58] Field of Search ..... 81/9.3, 419, 424.5, 81/426.5, 170

[56] References Cited

U.S. PATENT DOCUMENTS

| | | | |
|---|---|---|---|
| 200,971 | 3/1878 | Berdan et al. | 81/170 |
| 507,872 | 10/1893 | Allen . | |
| 699,349 | 5/1902 | Sargent, Jr. . | |
| 2,677,982 | 5/1954 | Arras et al. . | |
| 2,876,514 | 3/1959 | Murphy | 81/424.5 |
| 2,880,634 | 4/1959 | Betz . | |
| 2,935,907 | 5/1960 | Murphy . | |
| 3,145,388 | 8/1964 | Carpinella | 81/426.5 |
| 3,161,086 | 12/1964 | Kircher . | |
| 3,593,601 | 7/1971 | McFarland | 81/170 |
| 3,635,107 | 1/1972 | Schmidt . | |
| 4,162,640 | 7/1979 | Arnold . | |
| 4,610,187 | 9/1986 | Spaulding . | |
| 5,209,143 | 5/1993 | Sweet . | |
| 5,507,206 | 4/1996 | Solski . | |

*Primary Examiner*—James G. Smith
*Assistant Examiner*—Benjamin M. Halpern
*Attorney, Agent, or Firm*—Litman, McMahon & Brown, L.L.C.

[57] ABSTRACT

A clamp expander for an annular hose clamp includes first and second jaws for engaging first and second ends of the hose clamp. The jaws are mounted on ends of first and second plier sections for translation between open and closed positions thereof. A modified embodiment clamp expander includes first and second arms mounting the first and second jaws. The first arm is fixedly connected to a guide rod and the second arm is slidably mounted thereon for translation between open and closed positions by a draw bolt which connects the arms.

2 Claims, 3 Drawing Sheets

CLAMP EXPANDER

BACKGROUND OF THE INVENTION

1. Field of the Invention

The present invention relates generally to tools for use with clamps, and more particularly to a clamp expander for removing and installing hose clamps on vehicular hoses.

2. Description of the Related Art

Clamps are available in a wide variety of configurations for meeting the requirements of particular applications. For example, hose clamps are commonly used for mounting hose ends on various objects. Internal combustion engines typically have hoses in the cooling systems thereof for conveying engine coolant among the cooling system components such as radiators, water pumps, heaters, etc. Hoses have many other automotive vehicle applications, some of which require hose end clamps.

Different types of hose clamps are available. For example, one type of hose clamp includes a screw which must be tightened to constrict the clamp and affect a proper seal. Spring-type hose clamps can be formed of spring wire or a flat band-type spring material. Such spring-type hose clamps often include outwardly-projecting ears at their ends to facilitate installation and removal. The ears are squeezed together by hand or with a suitable tool such as a pair of pliers to expand the clamp. The hose clamp is normally expanded when being installed or removed since the larger diameter facilitates passage of a hose through the hose clamp. Moreover, hoses often swell with age and thus require extra hose clamp expansion to provide sufficient clearance for removal. Hose clamps used in automotive applications are often quite stiff and require considerable force for expansion.

Another factor which can increase the difficulty encountered in removing or installing a hose in an engine compartment relates to the accessibility of the hose clamps. Modern vehicles often include a number of hoses connecting various systems, such as cooling, emissions control, air conditioning, hydraulic, fuel and other systems. Hose clamp accessibility can be further complicated by the reduced sizes of the engine compartments in many vehicles. Thus, vehicle service technicians are often confronted with relatively complex engines installed in relatively small and crowded engine compartments. Under such conditions, hose clamp removal and installation can be particularly difficult because there is often little or no room in which to use a normal pair of pliers.

Another problem in dealing with hose clamps relates to the strike hazards they pose if suddenly released from a pair of pliers. For example, if the pliers slip, a hose clamp captured thereby can spring forth in an unexpected direction, with the possibility of attendant injury to personnel in the vicinity. Even if no one is injured, hose clamps are often lost in this manner whereby vehicle service operations are slowed and become more costly.

The present invention addresses some of the problems encountered in installing and removing hose clamps. Heretofore there has not been a clamp expander with the advantages and features of the present invention.

SUMMARY OF THE INVENTION

In the practice of the present invention, a clamp expander is provided for expanding an annular hose clamp including ends. The clamp expander includes first and second jaws with teeth forming sockets for receiving the hose clamp ends. First and second plier sections include respective jaw ends mounting the jaws and respective handle ends. The first and second plier sections are pivotally interconnected intermediate the plier section ends so that squeezing the handle ends of the plier sections translates the jaws towards a closed position thereof, thus expanding the hose clamp. A first modified embodiment of the present invention includes first and second arms mounting the first and second jaws and a guide rod fixedly connected to the first arm. The second arm is slidably mounted on the guide rod and is translatable with respect to the first arm by sliding along the guide rod. The second arm is translated along the guide rod by a draw bolt which interconnects the arms.

OBJECTS AND ADVANTAGES OF THE INVENTION

The principle objects and advantages of the present invention include: providing a clamp expander; providing such a clamp expander with jaws; providing such clamp expander which can be useful in removing and installing annular clamps; providing such a clamp expander which is usable in tight places; providing such a clamp expander which can be incorporated into a pair of pliers; providing such a clamp expander which can be operated by a socket wrench or some other similar tool; providing such a clamp expander which minimizes the risk of an annular clamp escaping; providing such a clamp expander which can increase the safety and efficiency of a hose installation or replacement procedure; providing such a clamp expander which is efficient in operation, economical to manufacture, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
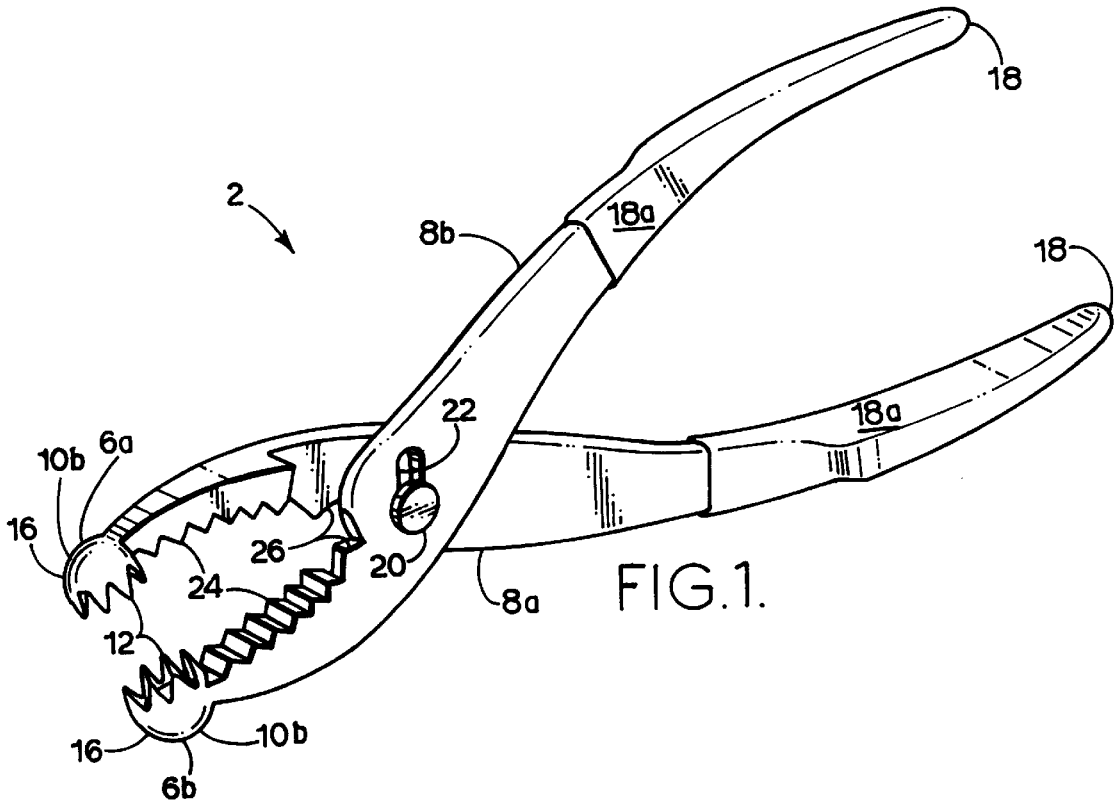
FIG. 1 is a perspective view of a pliers-type clamp expander embodying the present invention.
Figure 2:
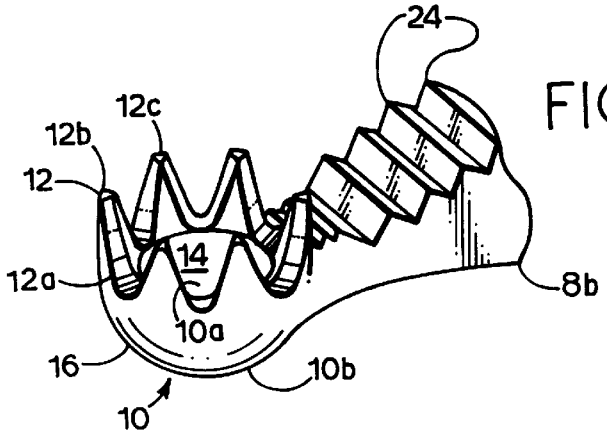
FIG. 2 is an enlarged, fragmentary, perspective view of a jaw thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 3:
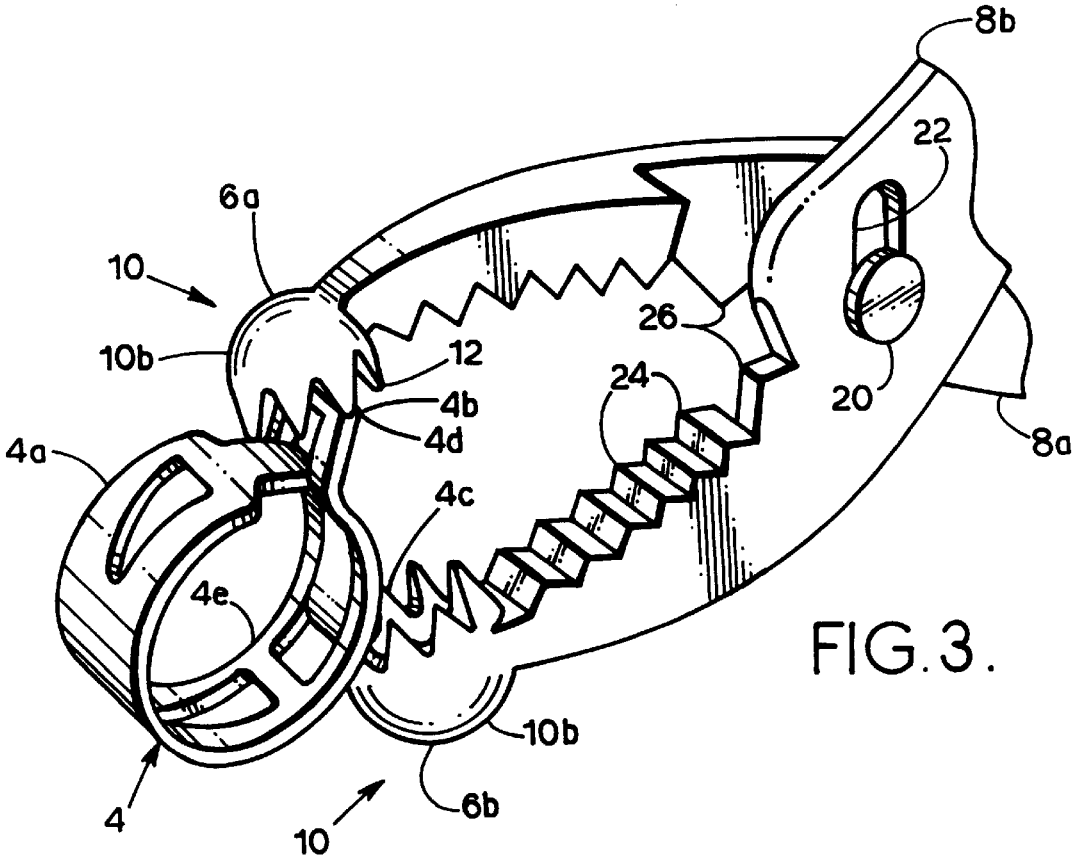
FIG. 3 is an enlarged, fragmentary, perspective view of the jaws and the pliers jaw ends thereof, shown compressing an annular hose clamp.

Referring to the drawings in more detail, the reference numeral 2 generally designates a clamp expander embodying the present invention. Without limitation on the generality of useful applications of the clamp expander 2, it has been found to be particularly useful for installing and removing annular clamps, particularly annular hose clamps such as that shown at 4 (FIG. 3). The hose clamp 4 includes an annular body 4*a* with first and second ends 4*b,c* having outwardly-projecting ears 4*d*. The is hose clamp body 4*a* forms a hose clamp passage 4*e* adapted to receive a hose or some other article to be clamped.

The hose clamp 4 shown is a flat band type designed to provide relatively constant tension. Other types of hose clamps include spring wire hose clamps formed from bent wire with a suitable spring constant for exerting a radially inwardly directed clamping force. The clamp expander 2 of the present invention is adapted to work with various hose clamp styles with ears such as those shown at 4*d*, which are engaged by the clamp expander 2.

The clamp expander 2 generally comprises first and second jaws 6*a,b* mounted on first and second plier sections 8*a,b* respectively.

II. Jaws 6*a,b*

The jaws 6*a,b* include jaw bodies 10 with inner and outer faces 10*a,b* oriented inwardly and outwardly respectively. The jaw body outer faces 10*b* can be outwardly convex and spherically rounded as shown.

A plurality of jaw teeth 12 project inwardly from each jaw body inner face 10*a* and generally encircle a respective jaw socket 14. Each tooth 12 has a generally triangular configuration with a tooth base 12*a* connected to a respective jaw body inner face 10*a* and an apex 12*b*. The jaw tooth apexes 12*b* can be somewhat flattened as shown at 12*c*. The jaw teeth 12 of each jaw 6 are arranged in a generally circular configuration around a respective socket 14.

III. Plier Sections 8*a,b*

Each plier section 8*a,b* includes a jaw end 16 and a handle end 8, the latter of which can include a suitable insulating coating 18*a*. The plier sections 8*a,b* are pivotably and slidably interconnected by a pivot pin 20 extending from the first plier section 8*a* and slidably and rotatably received in a slot 22 formed in the second plier section 8*b* between its jaw and handle ends 16, 18. The jaw ends 16 can include a plurality of ridges 24 facing inwardly for gripping other types of objects with the clamp expander 2 when used as pliers, and can further include cutting edges 26 positioned in opposed relation for cutting wires, etc.

IV. Operation

In operation, the clamp expander 2 is used in much the same way as a normal pair of pliers whereby leverage can be exerted on the plier section handle ends 18, which, when squeezed together, translate the jaws 6*a,b* from an open position thereof to a closed position. With the hose clamp ears 4*d* captured by the jaw teeth 12, squeezing the handle ends 18 has the effect of translating the hose clamp ears 4*d* together, thereby radially expanding the hose clamp body 4*a* and enlarging its passage 4*e*.

It will be appreciated that a service technician can normally retain the hose clamp 4 in an expanded configuration relatively easily, thus leaving the other hand free for manipulating a hose to be clamped or otherwise positioning the hose clamp 4. The clamp expander 2 is useful in operations involving both the installation and the removal of hose clamps 4.

The jaw teeth 12 further function to retain the hose clamp 4 in a particular angular orientation with respect to the clamp expander 2, whereby the spring action of the hose clamp 4 as its ears 4*d* are biased away from each other tends to retain the hose clamp 4 in the orientation with respect to the clamp expander 2 in which it was initially captured by the jaws 6. Thus, maneuvering and positioning the hose clamp 4, particularly in tight places with limited access, can be facilitated.

The number and spacing of the teeth 12 of the jaws 6 also permit capturing the hose clamp 4 in various angular orientations with respect to the clamp expander 2. For example, the hose clamp 4 can extend straight out from the clamp expander 2, or can project laterally to either side thereof or even rearwardly.

V. First Modified Embodiment Clamp Expander 102

Figure 4:
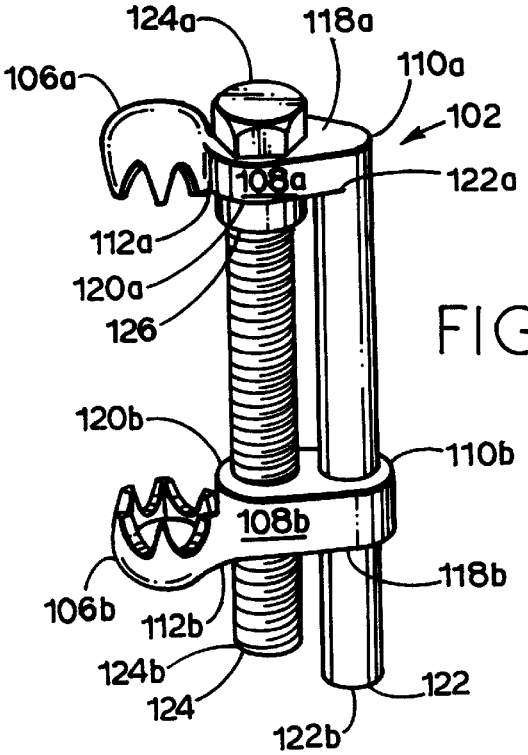
FIG. 4 is a perspective view of a clamp expander comprising a first modified embodiment of the present invention.
Figure 5:
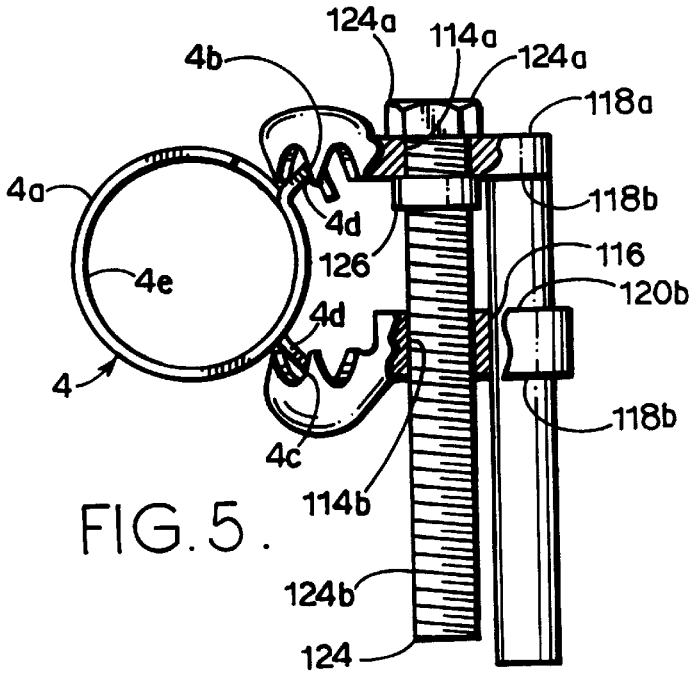
FIG. 5 is a side elevational view thereof, shown expanding an annular hose clamp.

A clamp expander 102 comprising a first modified embodiment of the present invention is shown in FIGS. 4 and 5. The clamp expander 102 includes first and second jaws 106*a,b*, which can be similar to the jaws 6*a,b* described above. First and second arms 108*a,b* include proximate ends 110*a,b* and distal ends 112*a,b* mounting respective jaws 106*a,b*. The first arm 108 includes a smooth-bore first bolt receiver 114*a* intermediate its ends 110*a*, 112*a*. The second arm 108*b* includes a female-threaded second bolt receiver 114*b* intermediate its ends 110*b*, 112*b* and a smooth-bore guide shaft receiver 116 positioned in proximity to the second arm proximate end 110*b*. The arms 108*a,b* include respective outer faces 118*a,b* and respective inner faces 120*a,b*.

A guide rod 122 includes a proximate end 122*a* fixedly mounted on the first arm proximate end 110*a* and a distal end 122*b*. The guide rod 122 thus extends approximately perpendicularly from the arms 108*a,b* and generally forms right angles therewith. The guide rod 122 slidably extends through the guide shaft receiver 116 of the second arm 108*b* in a relatively close fit therein whereby the second arm 108*b* can translate with respect to the guide shaft while maintaining its approximately 90° orientation with respect thereto. The tolerance between the guide shaft receiver 116 and the guide rod 122 is preferably such that relatively free sliding is permitted, but fairly close contact is maintained therebetween to support the second arm 108*b* in a generally perpendicular cantilever from the guide rod 122.

A draw bolt 124 includes a head 124*a* and a male-threaded shaft 124*b*. The bolt shaft 124*b* rotatably extends through the first arm bolt receiver 114*a* and is threadably received in the second arm bolt receiver 114*b*. A collar 126 is fixedly mounted on the bolt shaft 124*b* in slightly-spaced relation from the bolt head 124*a*. The first arm 108*a* is captured between the bolt head 124*a* and the collar 126 whereby the shaft 124*b* maintains a fairly constant-length extension from the first arm 108*a*.

VI. Operation

In operation, the clamp expanders 2, 102 function to efficiently expand a hose clamp such as that shown at 4. With the hose clamp ears 4*d* captured within the jaw sockets 14, the hose clamp 4 is substantially prevented from rotating. Thus, an angular orientation of the hose clamp 4 with respect to the clamp expander 2 or 102 can be maintained, even if the hose clamp 4 engages other objects as it is being installed. With the pliers-type clamp expander 2, the operator merely compresses or releases the pliers section handle ends 118 as necessary to achieve the desired degree of expansion.

The sockets 14 function to relatively securely clamp the hose clamp 4. In this configuration it is difficult for the hose clamp 4 to work its way loose from the clamp expander 2 or 102. The clamp expanders 2, 102 can be used for both installation and removal of hose clamps of different types.

The first modified clamp expander 102 is adapted for placement on a hose clamp, for example, in tight, out-of-the-way places within an engine compartment. The draw bolt 104 can then be rotated to achieve the desired spacing between the jaws 106*a,b*. Tightening the draw bolt 124 (i.e., clockwise) draws the jaw ears 4*d* closer together, whereby the clamp passage 4*e* expands, for example, to separate from an existing water hose or to slidably admit a water hose for installation purposes. The bolt head 124*a* and a collar 126 cooperate to maintain the first arm 108*a* therebetween whereby a substantially constant-length portion of the bolt shaft 124*b* extends generally parallel to the guide rod 122.

Although a hex-headed bolt 124 is shown, various other configurations of bolts could be utilized. For example, knurled knobs, wings, etc. could be used in place of the draw bolt hex head 124*a*. The hex head 124*a* is adapted for engagement by a suitable socket or wrench for turning. For example, a hose clamp located deep within an engine compartment can often be accessed utilizing the first modified clamp expander 102 and a suitable socket wrench with a socket mounted on an extension or extensions of suitable length.

It is to be understood that while certain forms of the present invention have been illustrated and described herein, it is not to be limited to the specific forms or arrangement of parts described and shown.

What is claimed and desired to be secured by Letters Patent is as follows:

1. An expander for an annular clamp with first and second ends, which includes:

(a) first and second jaws each having:
  (1) inner and outer faces;
  (2) a plurality of teeth arranged in an annular ring and projecting outwardly from said jaw inner face;
  (3) a socket formed within said teeth; and
  (4) each said tooth having a base adjacent to said jaw inner face, outwardly-converging edges and an apex positioned inwardly from said jaw inner face;

(b) first and second plier section each including:
  (1) a jaw end fixedly mounting a respective jaw; and
  (2) a handle end;

(c) one of said plier sections mounting a pivot pin extending laterally outwardly therefrom intermediate said jaw and handle ends;

(d) the other of said plier sections having an elongated slot extending transversely thereacross between said jaw and handle ends, said elongated slot rotatably and slidably receiving said pivot pin; and (e) each said jaw socket being adapted to receive a respective annular clamp end in a plurality of angular orientations with respect to a respective annular teeth ring, said annular clamp being adapted to rotate with respect to an axis generally concentric with said annular teeth rings and index between relative annular orientations associated with the annular spacing of said teeth.

2. An expander for an annular clamp with first and second ends, which includes:

(a) first and second jaws each having:
  (1) inner and outer faces;
  (2) a plurality of teeth arranged in an annular ring and projecting outwardly from said jaw inner face;
  (3) a socket formed within said teeth; and
  (4) each said tooth having a base adjacent to said jaw inner face, outwardly-converging edges and an apex positioned inwardly from said jaw inner face;

(b) a first arm including:
  (1) a jaw end fixedly mounting said first jaw;
  (2) a shaft end; and
  (3) a smooth-bore bold receiver positioned intermediate said jaw and shaft ends;

(c) a second arm including:
  (1) a jaw end fixedly mounting said second jaw;
  (2) a shaft end including a shaft receiver; and
  (3) a threaded bolt receiver with female threading and located between said jaw and shaft ends;

(d) a guide shaft with a proximate end mounted on said first arm shaft end and a distal end, said guide shaft being slidably received in said second arm shaft receiver;

(e) a draw bolt having a male-threaded shaft and a head, said draw bolt being rotatably received in said first arm bold receiver with said head positioned in proximity to said first arm and said bolt shaft being threadably received in said second arm bolt receiver;

(f) a collar fixedly mounted on said bolt in proximity to said bolt head with said first arm positioned between said bolt head and said collar; and (g) each said jaw socket being adapted to receive a respective anular clamp end in a plurality of angular orientations with respect to a respective annular teeth ring, said annular clamp being adapted to rotate with respect to an axis generally concentric with said annular teeth rings and index between relative angular orientations associated with the annular spacing of said teeth.

* * * * *